United States Patent [19]

Smith et al.

[11] 4,054,869

[45] Oct. 18, 1977

[54] SIGNAL SWITCHING CIRCUIT FOR MULTIPLE SOUND SIREN SYSTEM

[75] Inventors: Gerald D. Smith; Sammie S. Witte, both of Indianapolis, Ind.

[73] Assignee: Carson Manufacturing Company, Indianapolis, Ind.

[21] Appl. No.: 629,016

[22] Filed: Nov. 5, 1975

[51] Int. Cl.[2] ..... G08B 3/00

[52] U.S. Cl. ..... 340/384 E; 340/384 R

[58] Field of Search ..... 340/384 R, 384 E; 331/78, 56, 49

[56] References Cited

U.S. PATENT DOCUMENTS

| | | | |
|---|---|---|---|
| 2,910,688 | 10/1959 | Kelley et al. | 331/49 |
| 3,810,169 | 5/1974 | Locke | 340/384 R |
| 3,868,684 | 2/1975 | Nunn, Jr. | 340/384 E |

*Primary Examiner*—Harold I. Pitts
*Attorney, Agent, or Firm*—Gust, Irish, Jeffers & Rickert

[57] ABSTRACT

A circuit for switching between two signals of different frequency, such as "wail" and "yelp" of an electronic siren, by switching between different capacitive values in a multivibrator circuit. A monostable switch couples a reference level voltage to an integrated flip-flop circuit. The integrated circuit receives a reference level pulse when the monostable switch is closed and supplies a switching voltage to a transistor circuit. The transistor circuit places capacitances in parallel to change the time constant of the multivibrator circuit and also to change the characteristics of wave-shaping circuitry coupled to the multivibrator circuit. A reference level circuit accepts either of two voltage levels and provides a reference level voltage.

15 Claims, 1 Drawing Figure

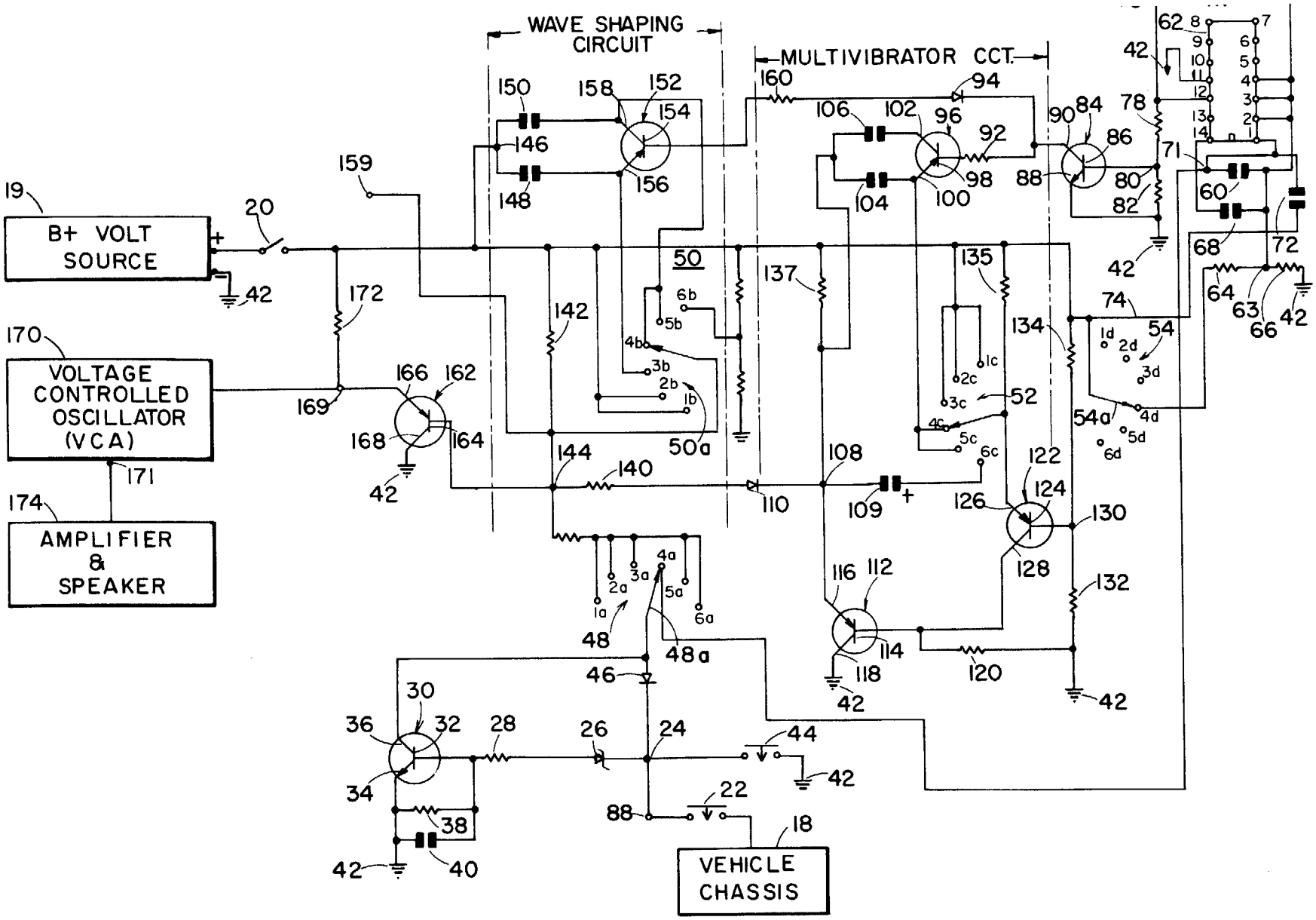
MULTIVIBRATOR CCT.
WAVE SHAPING CIRCUIT
VEHICLE CHASSIS
B+ VOLT SOURCE
VOLTAGE CONTROLLED OSCILLATOR (VCA)
AMPLIFIER & SPEAKER

SIGNAL SWITCHING CIRCUIT FOR MULTIPLE SOUND SIREN SYSTEM

BACKGROUND OF THE INVENTION

1. Field of the Invention

This invention is in the field of switching circuits and in particular the use of such circuits to change siren modes in emergency vehicle siren systems.

2. Brief Description of the Prior Art

Multivibrator circuits have been used for providing a variable voltage to a voltage controlled oscillator (VCO) in emergency vehicle siren circuits for many years. U.S. Pat. No. 3,747,092 entitled "ELECTRONIC SIREN CIRCUIT" inventor Gerald D. Smith, illustrates such a circuit. The VCO output frequency is amplified to provide a siren signal. In such a circuit, it is desirable to switch from one siren sound or mode to a distinctly different siren sound or mode for brief periods of time to provide an additional and more intensive warning sound during emergency situations. In previous circuits this was accomplished by manually holding a switch closed for the desired period of time; incorporating a predetermined time delay into a manual switch so that the second siren sound would be activated for the predetermined time upon the closing of a switch; or by manipulating a switch to activate the second siren sound and then manipulating a different switch to restore the first siren sound. The above approaches all have the disadvantages of inflexibility and the requirement of attention diverting manual operations during emergency vehicle operation.

SUMMARY OF THE INVENTION

This invention provides a circuit for an emergency vehicle siren which can switch from one vehicle siren sound, such as a "wail" sound, to a second more intensive siren sound, such as a "yelp" sound. The switching is accomplished by a momentary closing of a monostable switch which may conveniently be actuated by the vehicle horn ring or a foot switch. The "wail" siren sound may be restored by a momentary closing of the same monostable switch thus providing flexibility of siren operation and minimum operator manipulation during emergency periods. Further, the above circuit is equally adaptable to vehicle electrical systems where the vehicle chassis voltage level is positive or negative. The circuit is noise immune and stable. This invention provides a monostable switch between a reference level voltage and an integrated circuit which receives a voltage pulse and establishes an output bias voltage until a second reference voltage pulse is received. The reference voltage pulses are supplied by closing of the monostable switch. The bias voltage switches a control transistor "on" which in turn switches two circuit transistors "on" to place additional capacitance in multivibrator and wave-shaping circuits. One circuit transistor switches in capacitance to control the frequency of the multivibrator circuit and the second circuit transistor switches in capacitance to control the shaping of the multivibrator output waveform. The output signal of the multivibrator wave-shaping circuit is coupled to a VCO to produce the "wail" and "yelp" frequencies and these in turn are amplified to produce corresponding siren sounds.

Circuitry is also provided which will accept positive or negative vehicle chassis voltage levels and automatically convert these levels to a reference voltage level so that the circuit is adaptable automatically to vehicles which operate at different chassis voltage levels.

It is therefore an object of this invention to provide a circuit which will switch between either of two output frequencies to the other of the two output frequencies upon closing a switch.

It is an object to provide in a circuit of the foregoing object a switch coupling between a reference voltage and a flip-flop circuit, and circuit means to convert a plurality of voltage levels to the reference voltage.

It is an object to provide in the circuits of the foregoing objects means for coupling predetermined wave-shaping components operably into the circuit upon said switch closing.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWING

The drawing is a partial block diagram and schematic drawing of a preferred embodiment of this invention.

DESCRIPTION OF A PREFERRED EMBODIMENT

Referring to the drawing, a schematic is shown which has certain components common to those shown in the aforementioned Smith U.S. Pat. No. 3,747,092 with the common circuit components operating in similar manners.

The embodiment shown in the drawing is mounted in a vehicle having a chassis 18. Depending on the make of the vehicle, the chassis will be at either negative or positive battery potential, usually 12 volts. The manually operable circuit of this invention has a single conductor that may be connected to either vehicle chassis potential which will automatically provide a reference voltage for siren operation as will become apparent.

The vehicle has a B+ supply 19 such as a 12 volt vehicle battery and a power "on-off" switch 20 which may be mounted in fixed relation to the vehicle control or dash panel, as shown, supply 19 having its negative terminal connected to the siren circuit ground 42, and either its positive or negative terminal connected to vehicle chassis 18. In this description, the term ground potential refers to that potential at the negative post of supply 19. A monostable switch 22, spring urged to an open position as shown, is connected between chassis 18 and junction 24. Switch 22 is mounted in the vehicle within reach of the operator and may be associated with the vehicle horn ring so as to close when the ring is depressed. It may also be conveniently mounted for operation as a foot switch.

A zener diode 26, which has a breakdown voltage of $+7\frac{1}{2}$ V. is cathode connected to junction 24 and anode connected through current limiting resistor 28 to base 32 of NPN transistor 30. Emitter 34 of transistor 30 is connected by resistor 38 to base 32 to bias transistor 30 "off" in the absence of conduction by diode 26. Filter capacitor 40 is connected between ground 42 and base 32 and prevents stray radio frequency signals from triggering transistor 30. Switch 44 is a manual monostable switch connected between junction 24 and ground 42 and provides an additional circuit actuating switch.

Diode 46 is cathode connected to junction 24 and anode connected to rotor switch arm **48*a* of rotary switch 48. Switch 48 has stationary contacts 1***a* to 6*a* and is ganged with switches 50, 52 and 54 with their respective rotor arms 50*a*, 52*a* and 54*a* movable with rotor arm 48*a*. All switches have six fixed contacts but for the purpose of this description, arms 48*a*–54*a* will be considered in stationary contact with contacts 4*a*–4*d*, respectively, as shown.

Contact 4*a* of switch 48 is connected to capacitor 60 and to pin 1 of integrated circuit flip-flop circuit 62 which in this embodiment is a Fairchild High Speed TTL/SS1.9H73/54 73, 74H73. The specifications and operation of this circuit are available on pages 5–106 and 5–107 of Fairchild Semiconductor TTL Data Book dated June, 1972.

When potential is applied to pins 2, 3 and 4, capacitor 68 will charge applying a momentary positive pulse to pin 4 of circuit 62. This will allow pin 12 to rise in voltage to a level of +5.0 V. Pin 11 of circuit 62 is grounded.

Capacitor 60 is also connected to pin 1 of circuit 62 and to junction 63 between voltage divider resistors 64 and 66. Resistor 66 is connected to ground 42 and resistor 64 is connected to contact 4*d* of switch 54.

Capacitor 68 is connected between pin 14 of circuit 62 and junction 63 and receives a positive pulse from pin 14 on every input pulse to pin 1. Pins 2–4 are connected through resistor 70 to pin 12 for reasons later explained. Capacitor 72 is connected between circuit 62 pin 1 and B+ line 74 filtering noise on line 74 preventing any "bounce" or "chatter" due to noise that might result in a false triggering pulse.

After ground potential has been removed from the anode side of diode 46, as would occur upon opening of switch 22, the potential at pin 1 of circuit 62 is raised to the potential of juncture 71 between capacitors 60 and 72 which is intermediate the voltage level of junction 63 and line 74.

A voltage divider consisting of resistors 78 and 82, connected at junction 80, is connected between resistor 70 and ground 42. Base 86 of NPN transistor 84, having emitter 88 and collector 90, is connected to junction 80 and emitter 88 is connected to ground 42. Collector 90 is connected to resistor 92 and the cathode of diode 94. Base 98 of transistor 96, having emitter 100 and collector 102, is connected to resistor 92, emitter 100 is connected to contact 4*c* of switch 52 and to capacitor 104. Collector 102 is connected to capacitor 106, with capacitors 104 and 106 being connected together and to a juncture 108 which is between the cathode of diode 110 and the emitter 116 of PNP transistor 112 having base 114 and collector 118. Capacitor 109 connects junction 108 and terminal 6*c* of switch 52. The collector 118 is connected to ground 42 and base 114 is connected to resistor 120 and collector 128 of transistor 122 having base 124 and emitter 126. Base 124 is connected to the junction 130 between voltage divider resistors 132 and 134 which provide base bias therefor. Resistor 134 is connected to B+ line 74 and arm 54*a* of switch 54. Resistor 135 is connected between collector 126 and B+ line 74 and resistor 137 is connected between junction 108 and line 74.

As will be appreciated by those skilled in the art, transistors 112 and 122 are thus coupled in multivibrator relation and upon a B+ signal being applied to line 74, a multivibrator output signal will appear at the cathode of diode 110. When transistor 96 is conductive, both capacitances 104 and 106 will be in the circuit and the multivibrator will oscillate at a relatively slow rate and will produce a "wail" sound, and when transistor 96 is non-conductive, only capacitance 104 will be in the circuit producing a relatively high frequency or "yelp" siren sound.

A multivibrator wave-shaping circuit is provided and comprises voltage divider resistors 140 and 142 connected at junction 144 and capacitors 148 and 150. Resistor 142 is connected to B+ line 74, as is junction 146 between capacitors 148 and 150 which are connected respectively to emitter 156 and collector 158 of PNP transistor 152 having base 154. Base 154 is connected to resistor 160 which is connected to the anode of diode 94. Collector 158 is connected to contact 4*b* of switch 50 and switch arm 50*a* is connected to microphone terminal 159 for reasons defined in the above-mentioned Smith patent, and to base 164 of transistor 162 having emitter 166 and collector 168. Collector 168 is connected to ground 42 and emitter 166 is coupled to VCO 170, and to B+ line 74 through resistor 172.

VCO 170 is a variable frequency, astable multivibrator circuit. The operation of this type of circuit is well known to those skilled in the art and it is sufficient to state that it will generate a square wave signal having a frequency which is directly proportional to the voltage applied to its input terminal 169.

It will be understood by those skilled in the art that when transistor 152 is conductive, both capacitances 148 and 150 will be in the wave-shaping circuit and provide a "coast" or sloped wave shape to the multivibrator output signal in the "wail" mode appearing at junction 108, and when transistor 152 is non-conductive, only capacitance 150 will be in the wave-shaping circuit to add a steeper "coast" or slope to the wave shape at junction 108 for the multivibrator output signal in the "yelp" mode.

The multivibrator output signal at junction 108 from emitter 116 of transistor 112 is coupled to the base 164 of isolating transistor 162 and provides the voltage input control signal to VCO 170. The essentially square wave output from emitter 116 is shaped by the resistance-capacitance circuitry of resistor 142 and capacitance 150 for the "yelp" mode or capacitances 148 and 150 for the "wail" mode, depending on the conductive state of transistor 152. These waveforms may be similar to those shown in FIG. 3 of the aforementioned Smith patent and include waveforms A-1; A-2; B-1; B-2; C-1 and C-2 thereof. Voltage waveforms A-1, A-2 thereof would typically appear at the junction 108 for "wail" and "yelp" respectively. Voltage waveforms B-1, B-2 would typically appear at wave-forming output junction 144 for "wail" and "yelp" modes respectively and frequency waveforms C-1 and C-2 would appear at output 171 of VCO 170 for "wail" and "yelp", respectively. VCO 170 is coupled to amplifier speaker circuit 174 which will audibly produce the siren sounds.

OPERATION

In operation, switch 20 is closed, applying B+ voltage to line 74. With switch arms 48*a*–54*a* positioned on contacts 4*a*–4*d*, respectively, multivibrator circuitry will be in either the "wail" or "yelp" mode, depending on whether transistors 96 and 152 are conductive or non-conductive, respectively. Assuming transistors 96 and 152 are non-conductive, the circuit is in the "yelp" mode, and by simply closing switch 22, the circuit will be changed to the "wail" mode.

When switch 22 is closed, ground potential will be applied to the cathode of diode 46, whether vehicle chassis 18 is at a plus potential or negative potential. If chassis 18 is negative then, of course, ground potential is applied directly to the cathode of diode 46 upon closing of switch 22.

However, if vehicle chassis 18 is at a positive battery potential, closing of switch 22 will cause zener diode 26 to break down, applying a positive potential to base 32 causing transistor 30 to conduct. This effectively connects the anode of diode 46 to ground 42 thereby achieving the same result as when chassis 18 is at negative potential.

Ground potential at the anode of diode 46 is applied through switch 48 to pin 1 of circuit 62 causing a negative pulse at pin 3 and pin 12 to "flip" to a positive voltage (of about 12 volts), resulting in a positive voltage at junction 80 between resistors 78 and 82. Since pin 3 is pulsed negatively, current will flow from pin 12 through resistor 70, thereby momentarily raising or "pulling up" the potential at pin 12 and junction 80 to positively turn "on" transistor 84. Once transistor 84 is "on", the potential at junction 80 will fall slightly after the pulse at pin 3 but will be sufficient to maintain transistor 84 in the "on" condition.

Once transistor 84 is conductive, both base 98 of transistor 96 and base 154 of transistor 152 will be lowered to ground potential, turning these transistors "on", and placing capacitors 106 and 148, in parallel with capacitors 104 and 150, respectively.

When capacitor 106 is so placed in parallel with capacitor 104, the capacitance in the multivibrator circuit is substantially increased and the pulse frequency and pulse amplitude are correspondingly decreased, as is desired in the "wail" mode of the siren as understood by those skilled in the art. Also, when capacitor 148 is placed in parallel with capacitor 150, the capacitance in wave-shaping circuit is substantially increased, decreasing the slope of each pulse edge which also is desired in the "wail" mode of the siren.

The voltage waveform present at junction 144 is now that corresponding to the "wail" mode and this is applied to base 164 of transistor 162, causing corresponding conduction of transistor 162 and a corresponding voltage to VCO 170 which converts the voltage waveform to a corresponding variation in frequency. The output signal of VCO 170 is amplified and converted to an audible signal by amplifier and speaker circuit 174.

When it is desired to switch from the "wail" siren mode to the "yelp" siren mode, switch 22 is again closed applying ground potential to pin 1 of circuit 62 which causes the potential at pin 12 to "flop" or fall to ground, lowering the potential at junction 80, turning transistor 84 "off". This opens the circuits of bases 98 and 154, turning "off" transistors 96 and 152, respectively, removing capacitances 106, 148 from their respective parallel connections with capacitances 104, 150, raising the frequency and amplitude of the pulses from that multivibrator circuit and increasing the slope angle of the multivibrator pulse edges, placing the circuit in the "yelp" mode.

In switching from "wail" to "yelp" mode, the negative charge from capacitor 150 tends to bleed off from collector 158 to base 154 of transistor 152. This would cause a temporary negative voltage at base 98 of transistor 96 through resistors 160 and 92, causing transistor 96 to remain "on" for a short period after transistor 84 was turned "off". However, diode 94 blocks this negative discharge, insuring that transistor 96 is turned "off" simultaneously with transistor 84.

Following is listed values of the various components of a working embodiment of this invention, these values being given as exemplary only and not to be considered as limitative of the invention.

| RESISTORS | | CAPACITORS | |
|---|---|---|---|
| All resistors ±5% | | All capcitors V. unless otherwise indicated | |
| Reference numeral | Component | Reference numeral | Component |
| 28 | 2.2K | 40 | .1 MFD |
| 38 | 1.5K | 60 | 100 PFD |
| 64 | 220 | 68 | 4.7 MFD |
| 66 | 10K | 72 | 4.7 MFD |
| 70 | 2.2K | 104 | 15 MFD 10V. |
| 78 | 2.2K | 106 | 200 MFD 12V. |
| 82 | 47K | 109 | 47 MFD 10V. |
| 92 | 120K | 148 | 200 MFD 12V. |
| 120 | 22K | 150 | 15 MFD 10V. |
| 132 | 22K | | |
| 134 | 8.2K | | |
| 135 | 7.5K | | |
| 137 | 3.3K | | |
| 140 | 3.3K | | |
| 142 | 18K | | |
| 160 | 18K | | |
| 172 | 4.7K | | |
| TRANSISTORS | | DIODES | |
| Reference numeral | component | 26 | IN755 |
| 30 | SKA 6183 | 46 | IN4001 |
| 84 | SKA 6183 | 84 | IN457 |
| 96 | SKA 6182 | 110 | IN457 |
| 112 | SKA 6182 | INTEGRATED CIRCUIT | |
| 122 | SKA 6182 | 62 | 1C 1 SN 7473 |
| 152 | SKA 6182 | | |
| 162 | SKA 6182 | | |

What is claimed is:

1. Apparatus comprising:

variable frequency means for providing a first signal having a first frequency and a second signal having a second frequency; and control means selectively operable to produce first and second control signals for changing said variable frequency means from said first signal to said second signal, said control means being coupled to a single manually manipulable switch member operable between first and second positions for selecting respective ones of said first and second control signals, said control means changing said variable frequency means to said first signal upon operation of said switch member from said first to said second position and changing said variable frequency means to said second signal upon the next operation of said switch member from said first to said second position.

2. Apparatus according to claim 1 including:

voltage reference means having input and output circuits for receiving a plurality of different voltages at said input circuit and for providing a common reference voltage at its output circuit in response to any one of said plurality of different voltages; and said output circuit of said voltage reference means being coupled to said control means for changing between said first and second control signals when said switch member is operated between said first and second positions.

3. Apparatus according to claim 1 wherein said control means produces at least two voltage levels sequentially in response to successive movements of said switch member between said first and second positions; and said variable frequency means including a multivibrator coupled to said control means to receive said control signals, said multivibrator having a variable capacitance circuit responsive to said control signals, said variable capacitance circuit varying in capacitance in response to said two voltage levels; said multivibrator generating a frequency responsive to the change in capacitance of said variable capacitance circuit.

4. Apparatus according to claim 3 including:

a voltage controlled oscillator having input and output circuits, said input circuit being coupled to said multivibrator to receive said multivibrator frequency, said voltage controlled oscillator generating a signal in said output circuit which varies in frequency in response to a varying voltage signal coupled to the input circuit thereof; and amplifier and sound reproducing means being coupled to said voltage controlled oscillator output circuit for amplifying and producing audible signals corresponding to the frequency of the output signal of said voltage controlled oscillator.

5. Apparatus according to claim 3 including:

first and second voltage circuits;

said control means having an input and an output terminal;

a capacitance circuit having a first and a second capacitor connected at a juncture and in series between said first and second voltage circuits;

said switch member comprising a monostable switch operable between first and second positions and coupling said control means to a reference voltage; and said juncture being connected to said control means input terminal and said monostable switch, whereby when said monostable switch is moved from said first to said second position said reference voltage will be coupled to said control means input terminal and when said switch moves from said second position to said first position said input terminal will be at the voltage of said capacitance juncture intermediate the value of said first and second voltage points.

6. Apparatus according to claim 5 including: means for raising the voltage at said output terminal for a predetermined time after an input signal is applied to said input terminal.

7. Apparatus according to claim 5 wherein said control means has a second output terminal coupled through a resistor to said output terminal, said second output terminal being operative to supply a signal for a predetermined time after an input signal is applied to said input terminal whereby when signal is applied to said input terminal, the current flow between said output terminal and said second output terminal raising the voltage level at said output terminal for said predetermined period of time that said second output terminal is operative.

8. Apparatus according to claim 3 including:

a first transistor coupled between said control means and said multivibrator;

said variable capacitance circuit comprising a second transistor coupled to said first transistor and switchable between first and second states by said first transistor; and said variable capacitance circuit comprising a first capacitor and a second capacitor coupled to said first capacitor by said second transistor whereby when said second transistor is switched by said first transistor to a first state, said first and second capacitors are electrically coupled and when said second transistor is switched by said first transistor to a second state, said first and second capacitors are electrically decoupled.

9. Apparatus according to claim 8 including:

wave-shaping means coupled to said multivibrator for shaping the waves from said multivibrator, said wave-shaping means having a second variable capacitance circuit;

a third transistor coupled to said first transistor and switchable between first and second states by said first transistor; and said second variable capacitance circuit having a third capacitor coupled to a fourth capacitor coupled by said third transistor whereby when said third transistor is switched by said first transistor to a first state said third and fourth capacitors are electrically coupled, and when said third transistor is switched by said first transistor to a second state said third and fourth capacitors are electrically decoupled.

10. Apparatus according to claim 9 including diode means for coupling said second and third transistors for unidirectionally isolating said second and third transistors whereby the charge on said third transistor will be isolated from said second transistor thereby preventing false operation of said second transistor.

11. Apparatus according to claim 2 wherein said voltage reference means comprises:

a transistor having a base, an emitter, and a collector, said emitter being connected to said common reference voltage and said collector being coupled to said control means;

a diode being coupled between said control means and said switch member; and a zener diode being coupled between said switch member and the base of said transistor, whereby breakdown conduction of said zener diode biases said transistor to conduction to couple said common reference voltage to said control means.

12. Apparatus according to claim 11 including a biasing resistor coupling said transistor to said common reference voltage to bias said transistor to a non-conductive state when said switch member is in said first position, a capacitor being connected in parallel to said biasing resistor to suppress noise signals.

13. Apparatus comprising:

variable frequency means for providing a first signal having a first frequency and a second signal having a second frequency;

control means selectively operable to produce first and second control signals for changing said variable frequency means from said first signal to said second signal, said control means coupled to a switch member operable between first and second positions for selecting respective ones of said first and second control signals, said control means changing said variable frequency means to said first signal upon operation of said switch member from said first to said second position and changing said variable frequency means to said second signal upon the next operation of said switch member from said first to said second position;

voltage reference means having input and output circuits for receiving a plurality of different voltages at said input circuit and for providing a common reference voltage at its output circuit in response to any one of said plurality of different voltages;

said output circuit of said voltage reference means being coupled to said control means for changing between said first and second control signals when said switch member is operated between said first and second positions;

said control mean produces at least two voltage levels sequentially in response to successive movements of said switch member between said first and second positions;

said variable frequency means including a multivibrator coupled to said control signals, said multivibrator having a variable capacitance circuit coupled to said control signals, said variable capacitance circuit varying in capacitance in response to said at least two voltage levels; said multivibrator generating a frequency responsive to the change in capacitance of said variable capacitance circuit;

a voltage controlled oscillator having input and output circuits, said input circuit being coupled to said multivibrator to receive said multivibrator frequency, said voltage controlled oscillator generating a signal in said output circuit which varies in frequency in response to a varying voltage signal coupled to the input circuit thereof;

amplifier and sound reproducing means being coupled to said voltage controlled oscillator output circuit for amplifying and producing audible signals corresponding to the frequency of the output signal of said voltage controlled oscillator;

first and second voltage points;

said control means having an input and an output terminal;

a capacitance circuit having a first and a second capacitor connected at a juncture and in series between said first and second voltage points;

said switch member comprising a monostable switch having a first and second position coupling said control means and said common reference voltage;

said juncture being connected to said control means input terminal and said monostable switch, whereby when said monostable switch is moved from said first to said second position said common reference voltage will be coupled to said control means input terminal and when said switch moves from said second position to said first position said input terminal will be at the voltage of said capacitance juncture intermediate the value of said first and second voltage points; and means for raising the voltage at said output terminal for a predetermined time after an input signal is applied to said input terminal.

14. Apparatus according to claim 13 including:

said voltage reference means comprises a transistor having a base, an emitter, and a collector, said emitter being connected to said common reference voltage and said collector being coupled to said control means;

a diode being coupled between said control means and said switch member;

a zener diode being coupled between said switch member and the base of said transistor, whereby breakdown conduction of said zener diode biases said transistor to conduction to couple said common reference voltage to said control means; and a biasing resistor coupling said transistor to said common reference voltage to bias said transistor to a non-conductive state when said switch member is in said first position, a capacitor being connected in parallel to said biasing resistor to suppress noise signals.

15. Apparatus comprising:

variable frequency means for providing a first signal having a first frequency and a second signal having a second frequency;

control means selectively operable to produce first and second control signals for changing said variable frequency means from said first signal to said second signal, said control means coupled to a switch member operable between first and second positions for selecting respective ones of said first and second control signals, said control means changing said variable frequency means to said first signal upon operation of said switch member from said first to said second position and changing said variable frequency means to said second signal upon the next operation of said switch member from said first to said second position;

voltage reference means having input and output circuits for receiving a plurality of different voltages at said input circuit and for providing a common reference voltage at its output circuit in response to any one of said plurality of different voltages;

said output circuit of said voltage reference means being coupled to said control means for changing between said first and second control signals when said switch member is operated between said first and second positions;

said control means produces at least two voltage levels sequentially in response to successive movements of said switch member between said first and second positions;

said variable frequency means including a multivibrator coupled to said control signals, said multivibrator having a variable capacitance circuit coupled to said control signals, said variable capacitance circuit varying in capacitance in response to said at least two voltage levels; said multivibrator generating a frequency responsive to the change in capacitance of said variable capacitance circuit;

a voltage controlled oscillator having input and output circuits, said input circuit being coupled to said multivibrator to receive said multivibrator frequency, said voltage controlled oscillator generating a signal in said output circuit which varies in frequency in response to a varying voltage signal coupled to the input circuit thereof;

amplifier and sound reproducing means being coupled to said voltage controlled oscillator output circuit for amplifying and producing audible signals corresponding to the frequency of the output signal of said voltage controlled oscillator;

first and second voltage points;

said control means having an input and an output terminal;

a capacitance circuit having a first and a second capacitor connected at a juncture and in series between said first and second voltage points;

said switch member comprising a monostable switch having a first and second position coupling said control means and said common reference voltage;

said juncture being connected to said control means input terminal and said monostable switch, whereby when said monostable switch is moved from said first to said second position said common reference voltage will be coupled to said control means input terminal and when said switch moves from said second position to said first position said input terminal will be at the voltage of said capacitance juncture intermediate the value of said first and second voltage points;

said control means has a second output terminal coupled through a resistor to said output terminal, said second output terminal being operative to supply a signal for a predetermined time after an input signal is applied to said input terminal whereby when signal is applied to said input terminal, the current flow between said output terminal and said second output terminal raising the voltage level at said output terminal for said predetermined period of time that said second output terminal is operative;

a first transistor;

said variable capacitance coupled between said control means and said multivibrator, circuit comprising a second transistor coupled to said first transistor and switchable between first and second states by said first transistor;

said variable capacitance circuit comprising a first capacitor and a second capacitor coupled to said first capacitor by said second transistor whereby when said second transistor is switched by said first transistor to a first state, said first and second capacitors are electrically coupled and when said second transistor is switched by said first transistor to a second state, said first and second capacitors are electrically decoupled;

wave-shaping means coupled to said multivibrator for shaping the waves from said multivibrator, said wave-shaping means having a second variable capacitance circuit;

a third transistor coupled to said first transistor and switchable between first and second states by said first transistor;

said second variable capacitance circuit having a third capacitor coupled to a fourth capacitor coupled by said third transistor whereby when said third transistor is switched by said first transistor to a first state said third and fourth capacitors are electrically coupled, and when said third transistor is switched by said first transistor to a second state said third and fourth capacitors are electrically decoupled; and diode means for coupling said second and third transistors for unidirectionally isolating said second and third transistors whereby the charge on said third transistor will be isolated from said second transistor thereby preventing false operation of said second transistor.

* * * * *